US006726344B2

(12) United States Patent
Lee

(10) Patent No.: US 6,726,344 B2
(45) Date of Patent: Apr. 27, 2004

(54) DECORATIVE LAMP STAND WITH INTERCHANGEABLE RETAINING RING ASSEMBLY

(76) Inventor: Han-Ming Lee, P.O. Box 7-820, Taipei (TW)

( * ) Notice: Subject to any disclaimer, the term of this patent is extended or adjusted under 35 U.S.C. 154(b) by 0 days.

(21) Appl. No.: 10/189,850

(22) Filed: Jul. 8, 2002

(65) Prior Publication Data

US 2004/0004837 A1 Jan. 8, 2004

(51) Int. Cl.[7] ..... F21V 21/88
(52) U.S. Cl. ..... 362/250; 362/249; 362/396
(58) Field of Search ..... 362/249, 250, 362/396, 121, 430, 252, 806

(56) References Cited

U.S. PATENT DOCUMENTS 2,692,374 A * 10/1954 Carson ..... 439/425
4,573,108 A * 2/1986 Castiglia et al. ..... 362/123
6,056,418 A * 5/2000 Hsu ..... 362/249

* cited by examiner

*Primary Examiner*—Sandra O'Shea
*Assistant Examiner*—Bao Truong

(57) ABSTRACT

The present invention relates to a decorative lamp stand with interchangeable retaining ring assembly, having a design having a malleable stand and retaining rings, mainly using a square latch member as link between intervals by the axle of the stand, and the circumference of the retaining ring is coupled to an embedded connecting section, and such connecting section member has 4 sets of corner bars, and the inner angle at the end of each bar is substantially 90° in both directions with respect to the latching surface. A curved board separates two corner bars such that a fixing groove in a cross shape in the middle of the four corner bars can make adjustment to the variable angles of 90° in both directions or 180° for the coupling and positioning of the square latch member at every interval at the end of the embedded stand. The formative design or figure of a bendable stand is used to enhance the diversification, utility and performance of the media and the advertising on industrial operations.

1 Claim, 6 Drawing Sheets

DECORATIVE LAMP STAND WITH INTERCHANGEABLE RETAINING RING ASSEMBLY

BACKGROUND OF THE INVENTION

1. Field of the Invention

The present invention provides a decorative lamp stand with interchangeable retaining ring assembly which relates to a design comprising a malleable stand and retaining block, mainly using a square latch block as link between intervals by the axle of the stand, and the circumference of the retaining ring is coupled to an embedded connecting section, and such connecting section member has 4 sets of corner bars, and the inner angle at the end of each bar is substantially 90° in both directions with respect to the latching surface. A curved board separates two corner bars, such that a fixing groove in a cross shape in the middle of the four corner bars can make adjustment to the variable angles of 90° in both directions or 180° for the coupling and positioning of the square latch member at every interval at the end of the embedded stand. The formative design or figure of a bendable stand is used to enhance the diversification, utility and performance of the media and the advertising industries.

2. Description of the Prior Art

In common decorative lamp assembly, the coupling of the lamp base, light bulb, and power cord generally uses the traditional way of coupling the power cord and the connector of electric wire; the insulating layer of the wires are peeled and the copper wire is exposed to connect the connector of the electric wire. Such process is complicated and wasting time. Changing the upper body and the lower base of the lamp stand to assemble the wire device may enhance the effect of the aforementioned assembling of the components. However, the light bulb of such improvement is located at a place with an angle of 90° with respect to the electric wire integrated in parallel and between the bases. Since the arrangement of the integrated wire is not bent to any one of them, and the base cannot be coupled to the edge of the wall according to the position and directions, so that its use is only limited to the lighting and not for a better use.

SUMMARY OF THE INVENTION

The primary objective of the present invention is to provide a decorative lamp stand with interchangeable retaining ring assembly which relates to a design and operation comprising a malleable stand and retaining rings to enhance the diversification, utility and performance of the media and the advertising on industrial applications.

The secondary objective of the present invention is to provide a decorative lamp stand with interchangeable retaining ring assembly, wherein a square latch member is used to couple the axle of the stand between the intervals and embed it into a connecting section at the circumference of the retaining ring.

A further objective of the present invention is to provide a decorative lamp stand with interchangeable retaining ring assembly, wherein a connecting section member has 4 sets of corner bars. A curved board separates two corner bars, such that a fixing groove in a cross shape in the middle of the four corner bars can make adjustment to the variable angles of 90° in both directions or 180° for the coupling and positioning of the square latch member at every interval at the end of the embedded stand.

Another objective of the present invention is to provide a decorative lamp stand with interchangeable retaining ring assembly, wherein the inner angle at the end of each bar is substantially 90° in both directions with respect to the latching surface, and is embedded into the square latch member at each interval of the stand.

DETAILED DESCRIPTION OF THE PREFERRED EMBODIMENT

Figure 1:
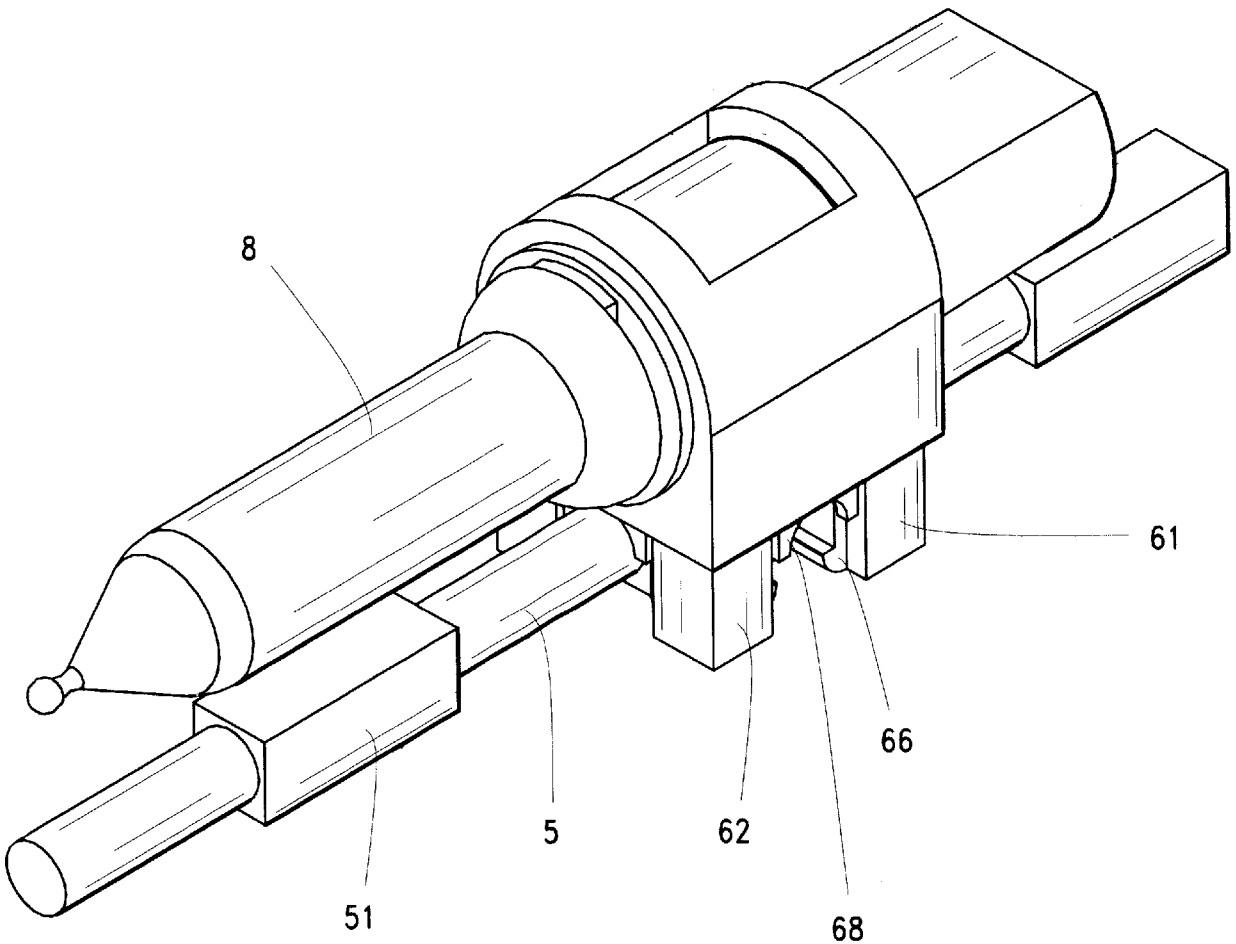
FIG. 1 is a schematic diagram of the decorative lamp stand with interchangeable retaining ring assembly according to a preferred embodiment of the present invention.
Figure 2:
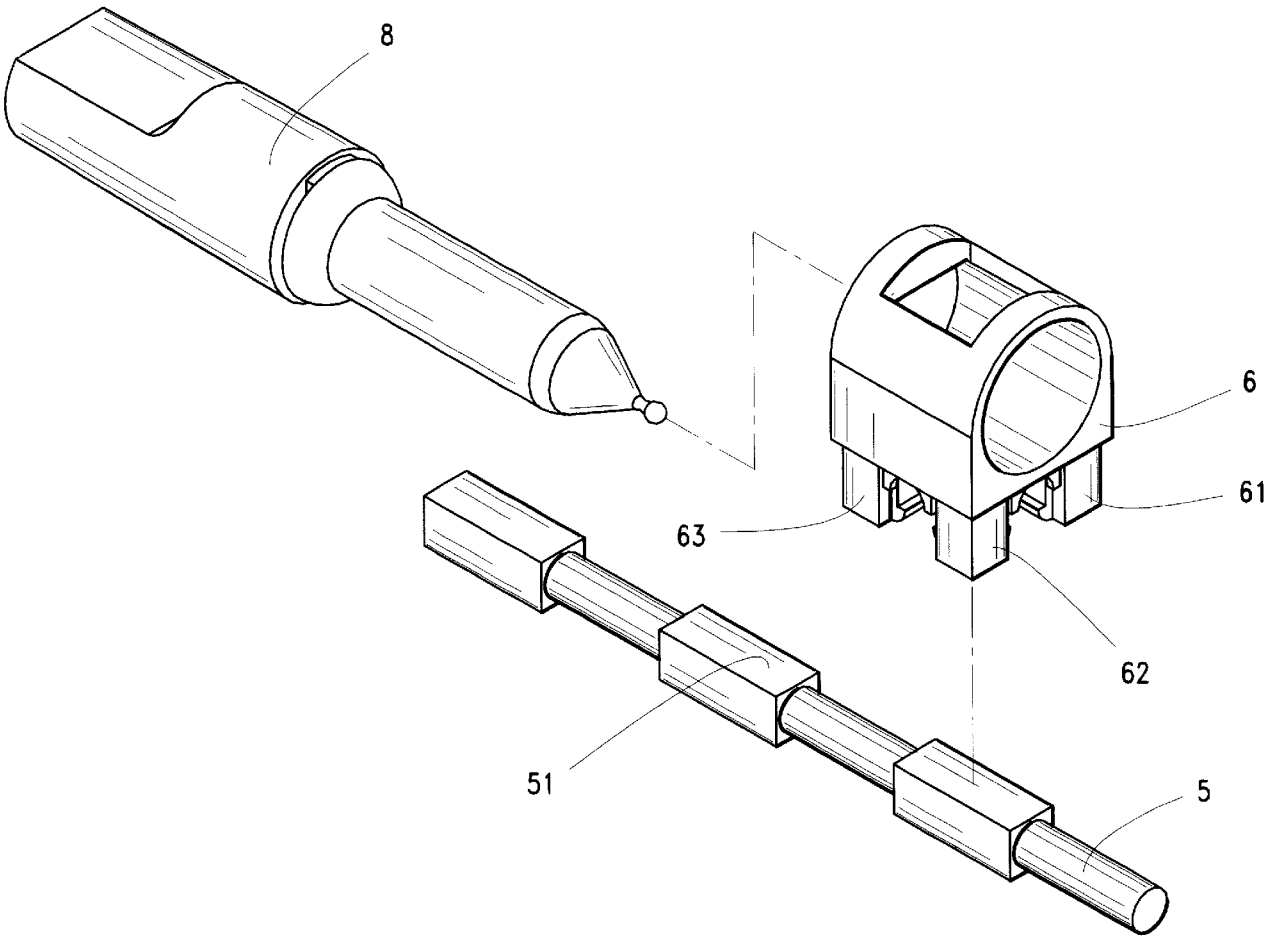
FIG. 2 is a diagram showing the parts of the interchangeable retaining ring and stand according to the present invention.
Figure 3:
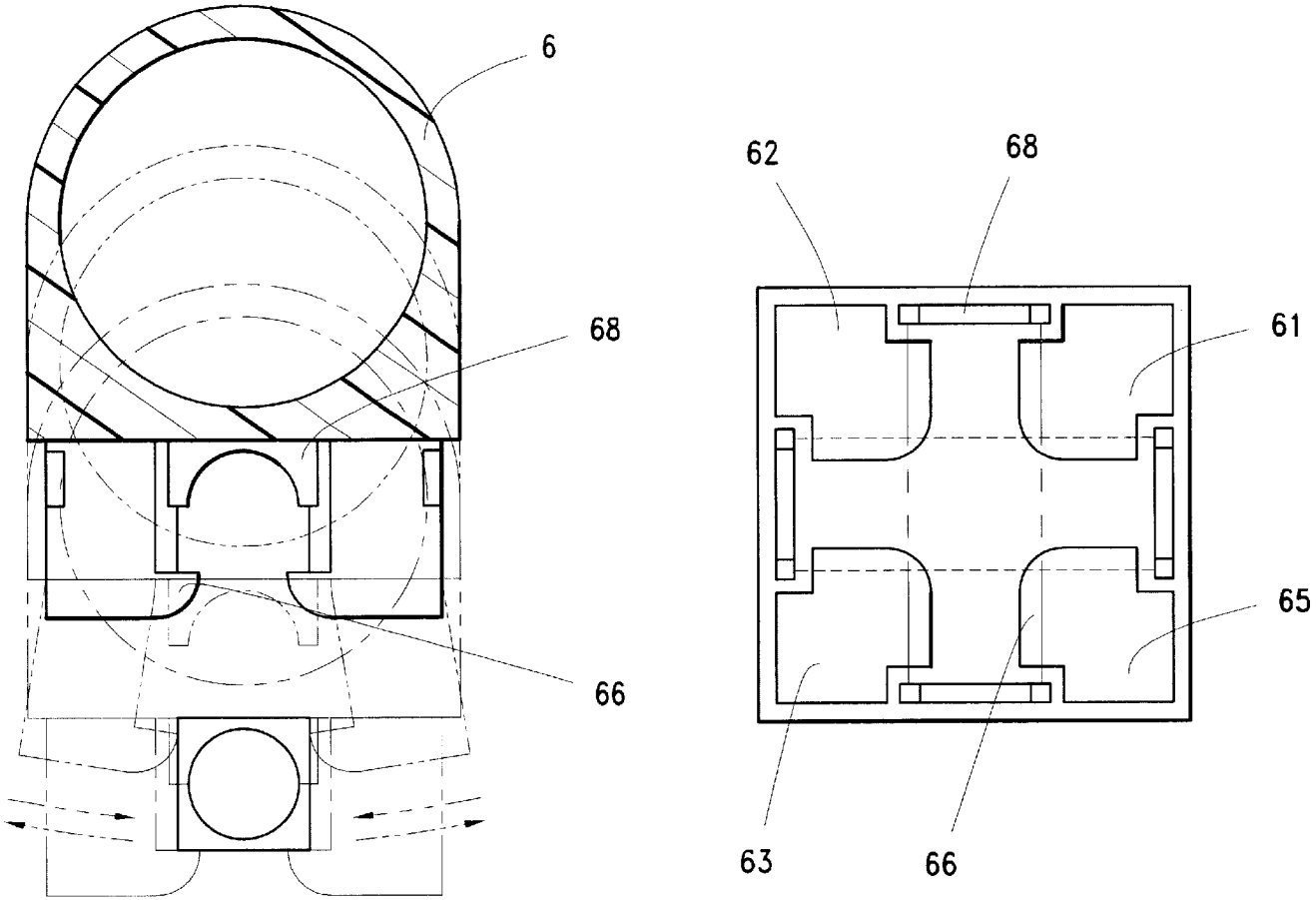
FIG. 3 is a diagram illustrating the coupling of the interchangeable retaining ring and the connecting section of the corner bar according to a preferred embodiment of the present invention.
Figure 4:
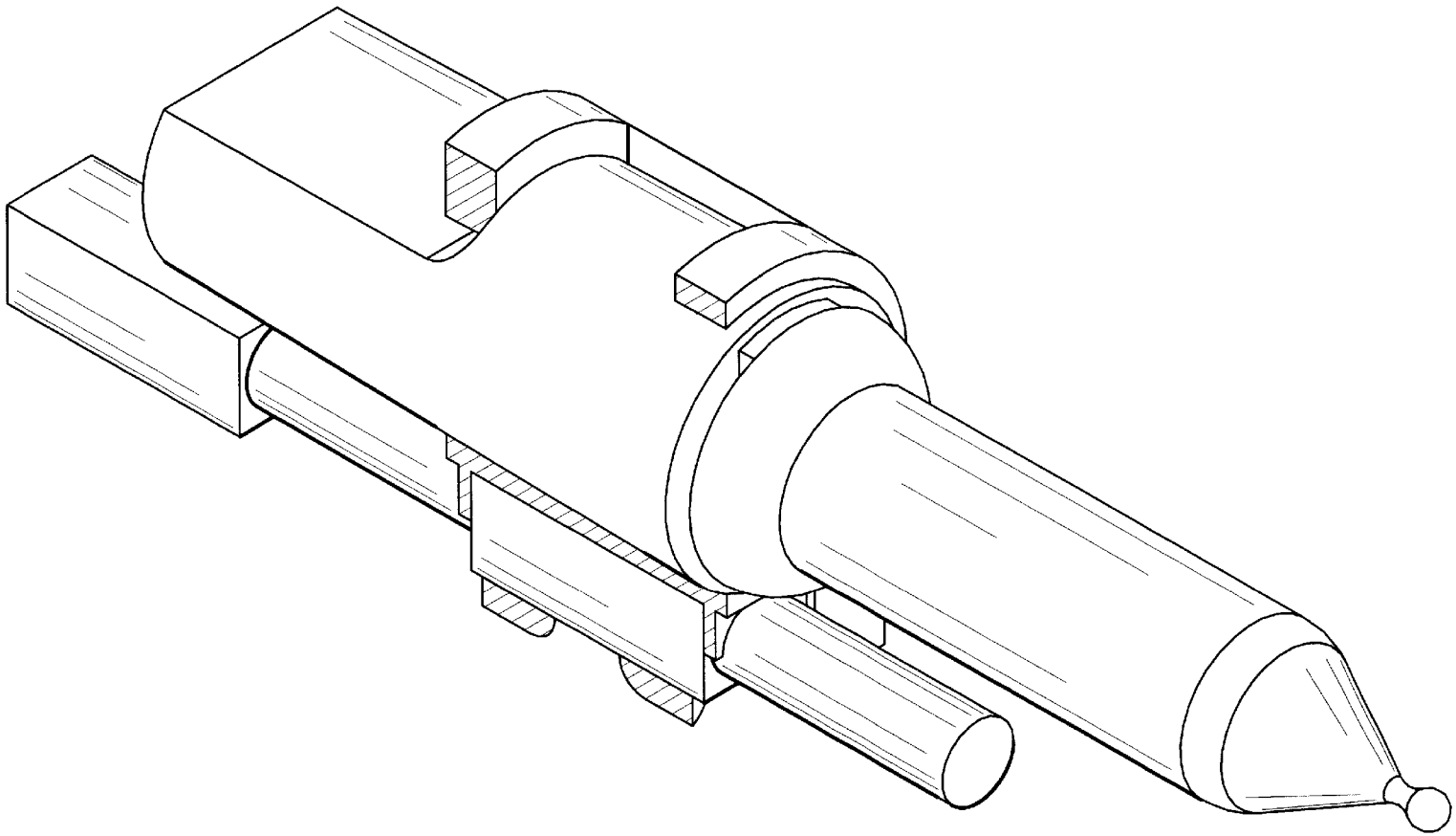
FIG. 4 is a cross-section diagram of another preferred embodiment of the present invention.
Figure 5:
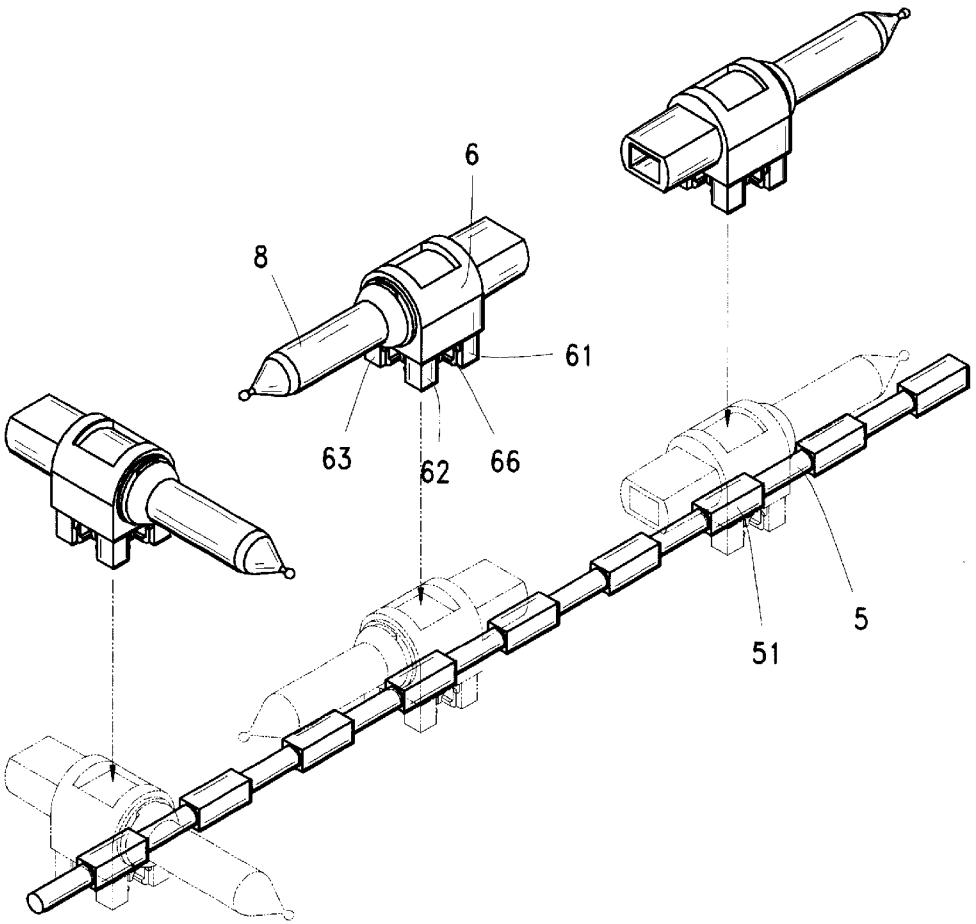
FIG. 5 is a diagram illustrating the adjustment made by the retaining ring corresponsive to the changing angle according to a preferred embodiment of the present invention.
Figure 6:
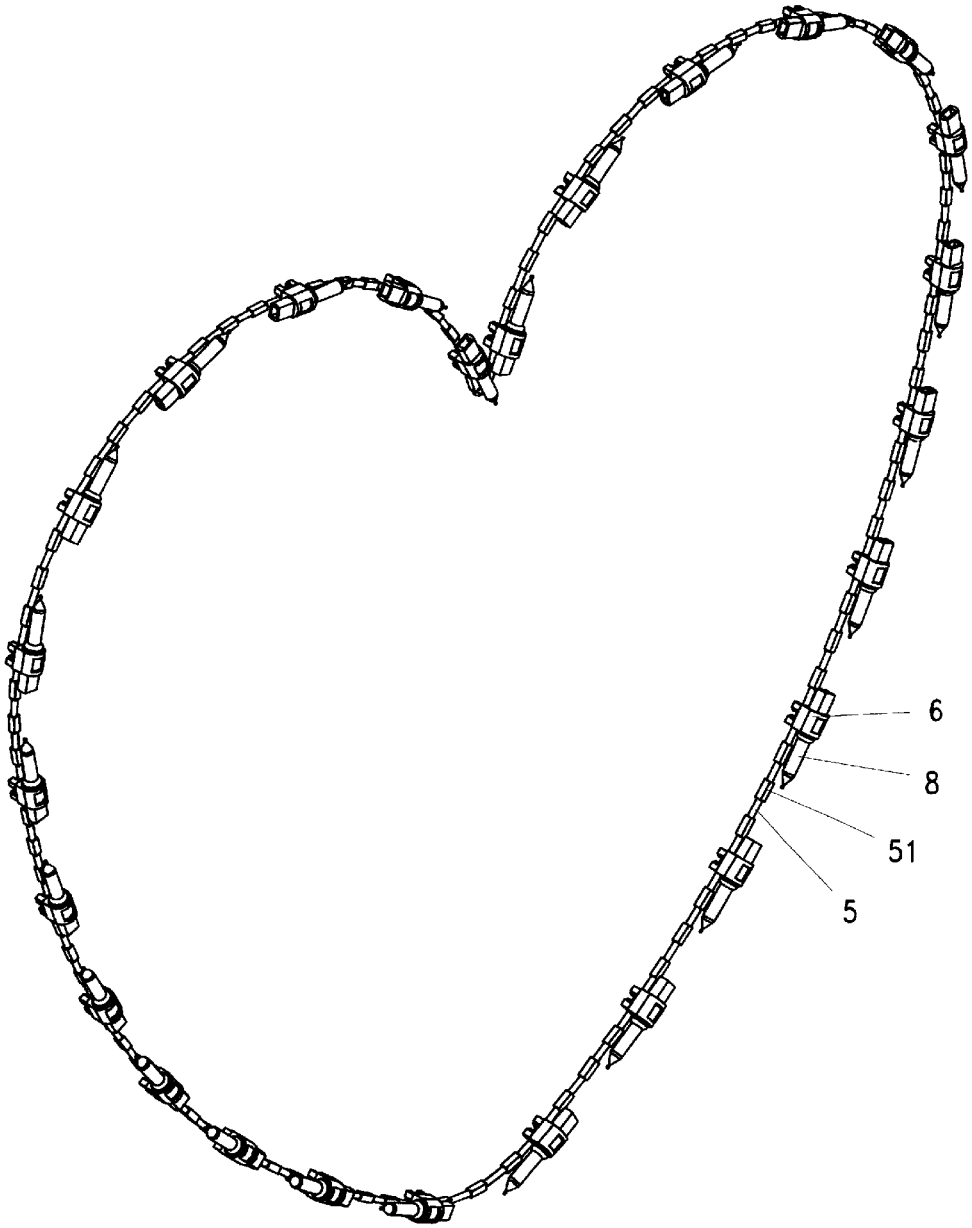
FIG. 6 is a schematic diagram of formative and variant figures of the bent stand for the retaining ring according to the present invention.

Referring to FIGS. 1 to 6, a decorative lamp stand with interchangeable retaining ring assembly of the present invention, comprising a malleable stand 5 and a retaining ring 6 coupled to an end of the variable stand, mainly using a square long latching section 51 on each interval on the circular surface of the axle bar of the stand 5, such that the circular axle between the square latch members can be bent and can change the angular direction, and a horizontal end on the circumference of the retaining ring 6 is coupled to an embedded connecting section, and such connecting section member has 4 sets of corner bars 61, 62, 63 and 65, and the inner angle at the end of each bar is substantially 90° in both directions with respect to the latching surface 66. A curved board 68 separates the interval of the two corner bars, such that the middle part of the four corner bars forms a cross moving shape as a fixing groove of embedded square latch member.

The function of the assembly according to the present invention makes use of the cross groove formed by coupling the connecting sections of the four corner bars with the retaining ring to embed a square latch member into each interval of the stand. The flexibility of the material for the corner bars disposed on both sides of the embedded member provides the elastic back and forth movement, such that the horizontal latching surface at the inner angle of the corner bar can be secured to the latching member. In the meantime, the two curved boards in the front and at the back of the square member are engaged to the curvature of circular axle of the stand, so that it latches the stand in the vertical direction. In addition, the curved design of the circular axle of the stand allows stylish words or figures to be shown in any angle. Such arrangement lets the light bulbs 8 be shown in the advertising sign or the media for promoting the atmosphere of festivals, and further enhances the diversified effect of implementation. It is the announcer of the initiative practice of the current decorative lamp industry.

While the invention has been described by means of specific embodiments, numerous modifications and variations could be made thereto by those skilled in the art without departing from the scope and spirit of the invention set forth in the claims.

What is claimed is:

1. A decorative lamp stand with interchangeable retaining ring assembly, having a interchangeable stand and a retaining ring coupled to a latching end of the stand, comprising:

a connecting section, substantially in the shape of a cube, disposed at each interval of a circular bar of the stand, such that the circular bar formed between the latching members being bendable and capable of changing the circular bar angular direction;

a retaining ring, having a diameter with a horizontal end, being coupled and embedded into the connecting section, and such connecting section having 4 sets of corner bars, each having a latching surface with an internal angle in both directions, and a curved board for separation being disposed in the middle of the four bars, such that the four bars forming an adjustable latching groove, substantially in the shape of a cross in the middle, and having a variable angle of 90 degrees in both directions or 180 degrees for the coupling on both sides with respect to the crossed groove for embedding the latching member at each interval of the stand; and a bendable design and figure being disposed on the stand for enhancing the diversification, utility and performance of the media and advertising effect.

* * * * *